United States Patent [19]

Harper

[11] 4,230,316

[45] Oct. 28, 1980

[54] METHOD OF PLAYING A BASEBALL BOARD GAME

[76] Inventor: Charles Harper, Site 12, Box 5, R.R. #1, Lively, Ontario, Canada, P0M 2E0

[21] Appl. No.: 910,856

[22] Filed: May 30, 1978

Related U.S. Application Data

[63] Continuation-in-part of Ser. No. 769,677, Feb. 17, 1977, abandoned.

[51] Int. Cl.[3] ..... A63F 3/00

[52] U.S. Cl. ..... 273/93 R

[58] Field of Search ..... 273/88, 93 R, 93 C, 273/95 R

[56] References Cited

U.S. PATENT DOCUMENTS

| | | | |
|---|---|---|---|
| 1,042,142 | 10/1912 | Pohlig | 273/93 R |
| 1,319,799 | 10/1919 | Sauper | 273/88 |
| 1,394,764 | 10/1921 | Sheehan | 273/93 R |
| 1,533,487 | 4/1925 | White | 273/88 |
| 1,703,628 | 2/1929 | Laesch | 273/88 |
| 3,948,527 | 4/1976 | Aguirregomezcorta | 273/253 |

FOREIGN PATENT DOCUMENTS

| | | | |
|---|---|---|---|
| 653227 | 12/1962 | Canada | 273/95 R |

*Primary Examiner*—Anton O. Oechsle
*Attorney, Agent, or Firm*—Robert D. Farkas

[57] ABSTRACT

A miniature baseball board game is played on a game board carrying color coded indicia thereon, having a predetermined play action surface area, a predetermined play non-action surface area, and having respective pluralities of predetermined apertures for receiving scoring markers therein. A game piece, or die, carrying indicia thereon determines the play action on the board by a throw of the game piece. There is positional interrelationship between the game board surface and game piece, according to the rules of play insofar as determining the play action recorded on the game piece. Markers are provided which are received in the apertures in the board to record the play action thereon, in accordance with the rules of baseball.

2 Claims, 2 Drawing Figures

FIG. 1
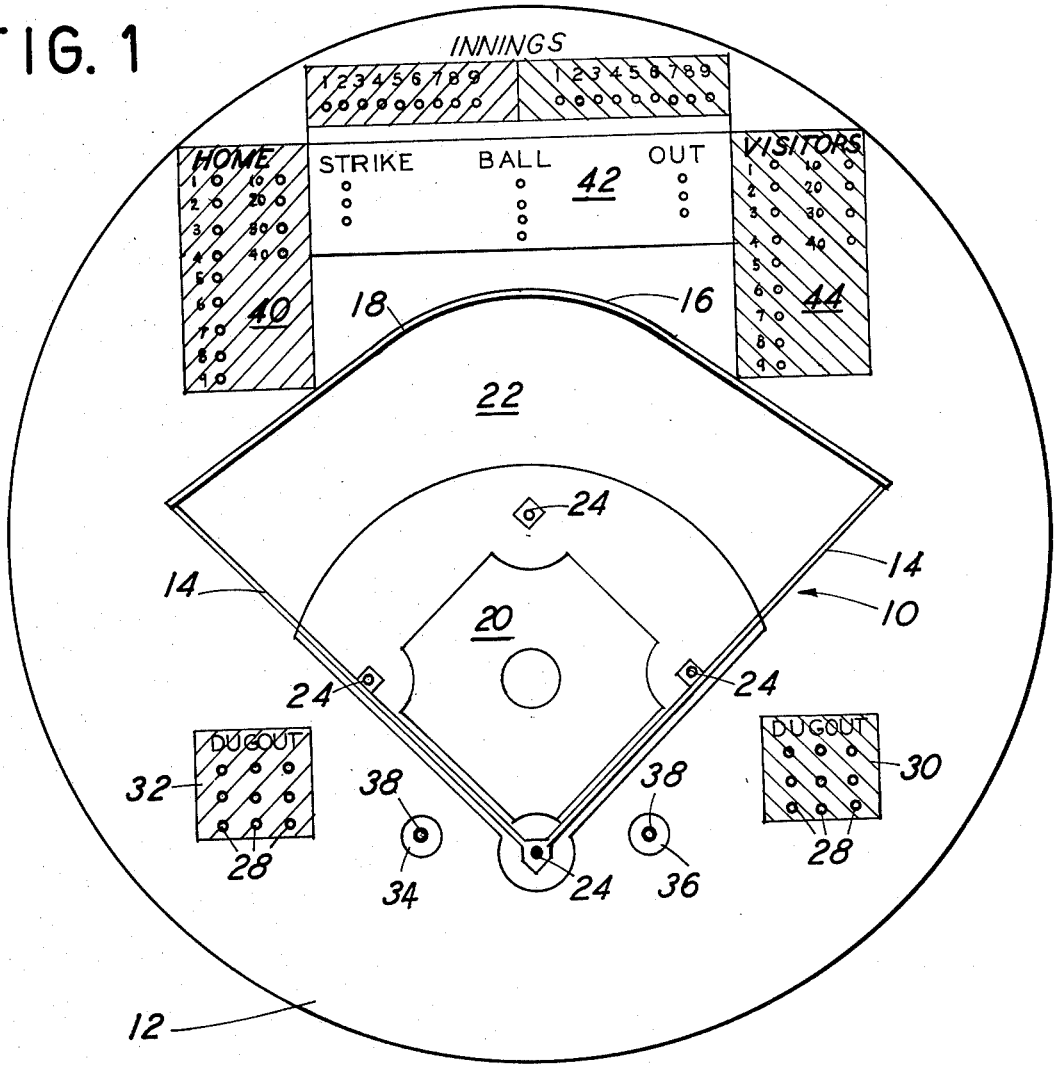
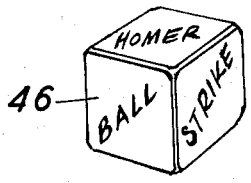
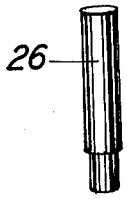
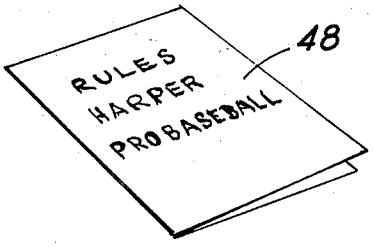
FIG. 2

METHOD OF PLAYING A BASEBALL BOARD GAME

BACKGROUND OF THE INVENTION

This application is a continuation-in-part of prior U.S. application Ser. No. 769,677, filed Feb. 17, 1977 abandoned.

The present invention relates generally to a board game, and more particularly to a baseball board game, upon which a method for playing baseball thereon.

Prior baseball board games are known. These heretofore known baseball board games are, however, complex or played from intricate instructions.

Accordingly, the instant invention provides an easily understood baseball board game that substantially simulates play. The rules of play provide an authentic approach to the game.

SUMMARY OF THE INVENTION

Generally speaking, in accordance with the invention, a baseball board game is provided which includes a game board carrying color coded indicia thereon, having a predetermined play action surface area, a predetermined non-play action area on the surface area, and having respective pluralities of predetermined apertures therein. A game piece carrying indicia thereon determines the play action on the board. There is an interrelationship between the game board surface and game piece according to the rules of play insofar as determining the play action recorded on the game piece. Markers are provided which are received in the apertures in the board to record the play action thereon. The location of the game piece, when thrown, determines the play action, irrespective of the indicia exposed on the game piece, when thrown in the non-play action area, as contrasted with the play action area.

Accordingly, it is an object of the invention to provide a novel board game.

Another object of the invention is to provide a novel baseball board game.

A further object of the invention is to provide an easily understood baseball board game that substantially simulates play.

Still another object of the invention is to provide a baseball board game that appeals to youngsters and oldsters alike.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWING

For a fuller understanding of the invention, reference is had to the following description taken in connection with the accompanying drawing, in which:

FIG. 1 is a plan view of the game board used in accordance with the instant invention; and FIG. 2 is a composite perspective view of the game piece, marker, and rules booklet which determine and record play on the game board.

DETAILED DESCRIPTION OF THE INVENTION

Referring now to the drawing, a play action sector 10 representing the conventional baseball diamond and playing field is marked out on substantially circular board 12. The extreme radial boundaries 14 of the sector 10 simulate foul lines found on the conventional playing surface. The extreme outer arc 16 of sector 10 is marked by a parabolic fence 18 mounted on board 12 which simulates the customary "ball park fence."

In sector 10 indicia 20 designates the "baseball diamond" and "infield", including the "bases," "pitching mound," and "base lines." The "outfield" is designated by a concomitant indicia 22. Each base including home plate is provided with an aperture 24 in which a marker 26 may be received. Beyond indicia 20, the "outfield" is represented by an indicia 22. To the right and left, respectively, of the first and third base lines are color coded indicia 30 and 32 which respectively represent the "dugouts" for the home and visiting teams. Each dugout 30 and 32 is provided with nine (9) apertures 28 in which markers 26 may be received. Eighteen (18) markers 26 are provided to represent the "players" for each team. Each set of nine (9) markers 26 is differently color coded to distinguish between the respective teams. To the right and left of home plate discrete indicia 34 and 36 is provided to respectively designate the "batter's on deck circle" for each team. An aperture 38 is provided in each batter's circle 34 and 36 so that an appropriate marker 26 can be advanced thereto as the game is played. Additional identically color coded markers 26 are provided for the purpose of recording the progress of the game, as hereinafter described in detail.

Beyond the playing sector 10 additional indicia 40, 42 and 44 is provided to respectively designate the home team score, innings played and batter and team progress, and visiting team score. The indicia is suitably apertured to receive the markers 26, whereby the game score may be suitably recorded by appropriately advancing the suitable marker 26.

A game piece 46 is provided which determines the play action sequence on the board 12. Game piece 46 is a die having one face coded with the designation "homer," another face coded with the designation "out," two faces coded with the designation "strike," and two faces coded with the designation "single." The game is played according to printed indicia provided in a Rules Booklet 48.

In practice, respectively color coded markers 26 are suitably mounted in the apertures provided in dugouts 30 and 32. Each competitor representing his respective team rolls the die to determine the first at bat. The highest scorer on roll "bats" first, while the other "pitches." The sequence established from highest to lowest score on the roll of the die is as follows:

Homer
Single
Ball
Strike
Out

The die is cast into the play action sector 10 of the board 12. The reading on the die determines the play action, unless it touches on the foul lines 14 provided on the board 12 in which circumstance the action is recorded as a "ball," no matter what reading is shown on the die 46, and unless the die is cast over fence 18 into the non-play action area of the board, in which circumstances a "ball" is also recorded without regard for the reading on the die. In accordance with the standard rules of baseball, a total of four "balls" mandates a "walk" by the batter. In the present invention, a total of four "balls" may be achieved by summing together the number of times the die lands in the play action area, having its uppermost surface denoting "ball," and the number of times the die lands in the non-play action area, without regard to the indicia appearing on the uppermost face. This results in a "walk" being scored by the batter.

Thus, when the die is cast into the play action area, play action sector 10 of the board 12, the die face which is exposed in the uppermost position, over the play action sector of the playing surface carrying the words "homer," "single," "strike," "ball," and "out" thereon, causes a marker 26 to be positioned from one aperture 24 to an adjacent aperture 22 in counter clockwise rotation, baseball-like fashion, when the word "single" appears in the uppermost position. When the word "out" appears, the marker 26, positioned in the home plate aperture 24, is removed and replaced by another marker 26, provided that an inning is in progress. Similarly, the word "strike", when upturned in the upward position, and the word "ball," denotes scoring levels which do not require the motion of the marker about foul lines, and from base to base. Clearly, the die, when hitting a marker, positioned at any base, may be deflected into the play action sector 10 rather than being cast beyond the foul lines 14 and ending up in a dormant position in the non-play action area on the board. In all other respects, the playing of the game, simulates the playing of a conventional baseball game.

Each pitch is recorded on indicia 42 until the player makes three (3) "outs," and the inning by inning score is then shown on the appropriate scoreboard 40 or 44. After three (3) "outs" are made, the batter becomes the pitcher and vice versa. In other words, the pitcher casts the die for the batter's team, and the player batting records the score. This procedure continues until nine innings have been played. At the end of the nine innings, the highest score prevails. If the players have recorded identical scores at the end of the regulation nine innings, then the players proceed to play extra innings until the deadlock is broken.

It will thus be seen that the objects set forth above among those made apparent from the preceding description, are efficiently attained and, since certain changes may be made in the above constructions without departing from the spirit and scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A method for playing miniature baseball utilizing a game board having a playing surface thereon, said playing surface delineating a play action area from a non-play action area, said game board having a plurality of apertures residing at the boundary between said play action area and said non-play action area, a die having indicia in the form of words disposed on the faces thereof, said words describing the baseball occurrences "homer," "single," "ball," "strike" and "out," a marker for removable insertion into said apertures, whereby the method comprises the step of throwing the die onto the surface of the game board, followed by the step of scoring the results described by the chance landing of the die in either the play action area or the non-play action area, followed by the steps whereby said marker may be manually advanced in accordance with the standard rules of baseball from one base to an adjacent base as directed by the baseball game occurrence indicated by the indicia on the uppermost die face in progressive fashion, normally only when said die lands in said play action area, the die when landing in the non-play action area scoring as a "ball" regardless of what indicia appears on the uppermost die face, and whereby said marker may be normally advanced in said progressive fashion when said die lands upon said non-play action area in accordance with said standard rules of baseball only if such landing results in the scoring of the fourth "ball" before the occurrence of an "out".

2. The method as claimed in claim 1 further comprising the additional step of manually replacing said marker with another marker after said marker has been moved in circuitous fashion in said progressive fashion and upon selected indicia being exposed in an uppermost position above said playing surface when said die lands in said play action area.

* * * * *